US005791024A

United States Patent [19]

Jovanovich

[11] Patent Number: 5,791,024

[45] Date of Patent: Aug. 11, 1998

[54] SIDE-ACTUATED CLIP

[76] Inventor: Radomir M. Jovanovich, 1700 Robin La., Glenview, Ill. 60025

[21] Appl. No.: 833,543

[22] Filed: Apr. 7, 1997

Related U.S. Application Data

[62] Division of Ser. No. 684,301, Jul. 18, 1996, Pat. No. 5,651,167.

[51] Int. Cl.[6] ..... A44B 21/00

[52] U.S. Cl. ..... 24/502; 24/503; 24/509

[58] Field of Search ..... 24/502, 503, 509, 24/563, 67.9, 3.11, 494, 495, 496, 498, 499, 114.05, 513, 514, 510, 540

[56] References Cited

U.S. PATENT DOCUMENTS

| | | | |
|---|---|---|---|
| 428,012 | 5/1890 | Lucas . | |
| 474,719 | 5/1892 | Brande . | |
| 581,810 | 5/1897 | Clarkson . | |
| 644,894 | 3/1900 | Carlin . | |
| 904,595 | 11/1908 | Barmore | 24/509 |
| 1,615,889 | 2/1927 | Senn | 24/509 |
| 1,634,532 | 7/1927 | Bowe . | |
| 2,596,635 | 5/1952 | Wolfe | 24/503 |
| 2,601,193 | 6/1952 | Wettley . | |
| 2,749,098 | 6/1956 | Johnson . | |
| 2,991,522 | 7/1961 | Balkind | 24/502 |
| 4,322,711 | 3/1982 | Spangler et al. . | |

*Primary Examiner*—Victor N. Sakran
*Attorney, Agent, or Firm*—Y. Judd Azulay

[57] ABSTRACT

A side-actuated clip that is actuated by using only one hand. The clip consists of two halves, withone stationary and the other pivotal. A pivot shaft having a helical shape passes through a mounting bracket of the second, pivotal plate-half. The mounting bracket has an interior opening corresponding to the shape of the helically-shaped pivot shaft. The pivot shaft is spring biased. As the pivot shaft is translated in the mounting bracket secured to the second, pivotal plate-half, such movement causes the second plate-half to pivot open or closed, depending upon the direction of translation of the pivot shaft. The spring biases the shaft in a linear direction that pivots the second plate-half into its closed, clamping position.

3 Claims, 5 Drawing Sheets

SIDE-ACTUATED CLIP

This is a divisional of application Ser. No. 08/684,301 filed on Jul. 18, 1996 now U.S. Pat. No. 5651,167

BACKGROUND OF THE INVENTION

The present invention is directed to a clip, or clamp, having multiple uses, such as holding papers or documents together, or as an identifying clip that may be worn on the person, or for use in any environment where a clip, or clamp, is necessary. Since prior-art clips or clamps generally require the use of two hands to operate , it is the intent and objective of the present invention to provide a clip, or clamp, that is operated, or actuated, by the use of just one hand, in order to allow easier use and operation.

SUMMARY OF THE INVENTION

It is the primary objective of the present invention to provide a spring-biased clip for holding articles, which clip is actuated to its opened, article-receiving position by the use of just one hand.

It is another objective of the present invention to provide such a spring-biased clip for holding articles, which clip is actuated to its opened, article-receiving position by squeezing together the ends of the clip.

It is yet another objective of the present invention to provide such a spring-biased clip for holding articles, such that by squeezing the ends of the clip, a spring-biased, screw-shaped, or helically-shaped, pivot pin is moved linearly through a mating cross-sectioned bracket member, in opposition to the force of the spring, by which the linear movement of the pivot rod is translated into rotation movement of one of the two halves of the clip.

BRIEF DESCRIPTION OF THE DRAWINGS

The invention will be more readily understood with reference to the accompanying drawing, wherein.

DETAILED DESCRIPTION OF THE INVENTION

Figure 1:
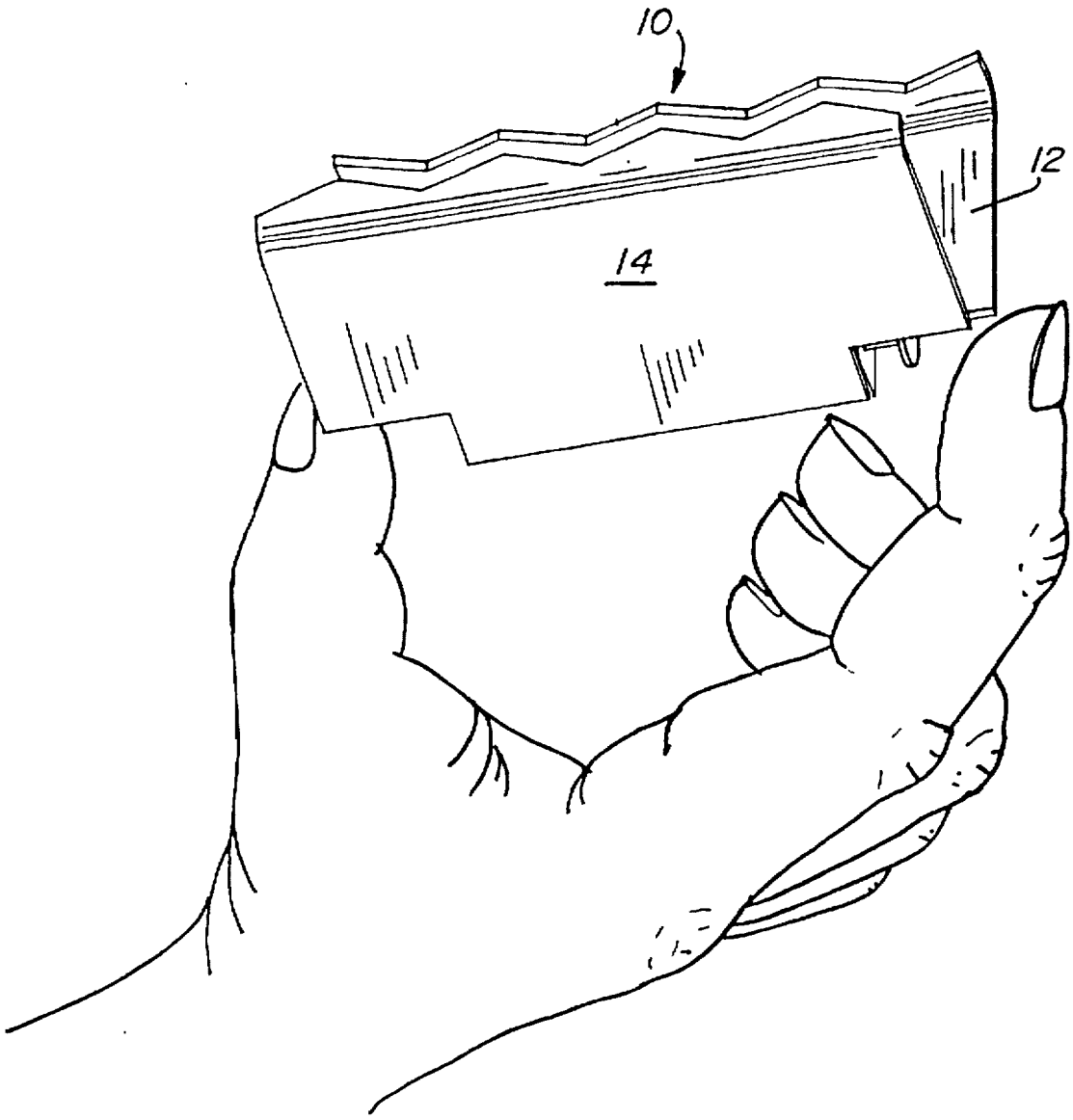
FIG. 1 is a perspective view of the side-actuated clip of the invention.
Figure 2:
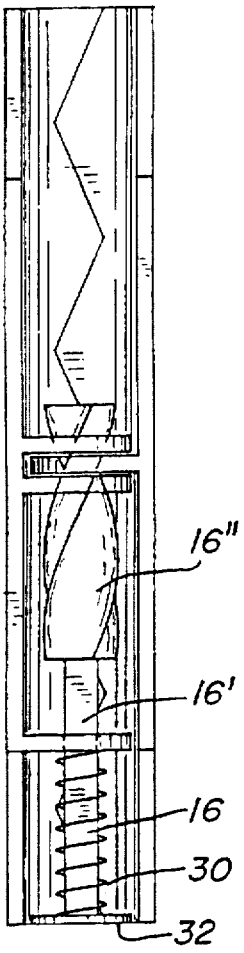
FIG. 2 is a bottom view of the clip of FIG. 1 showing the working parts thereof.
Figure 3:
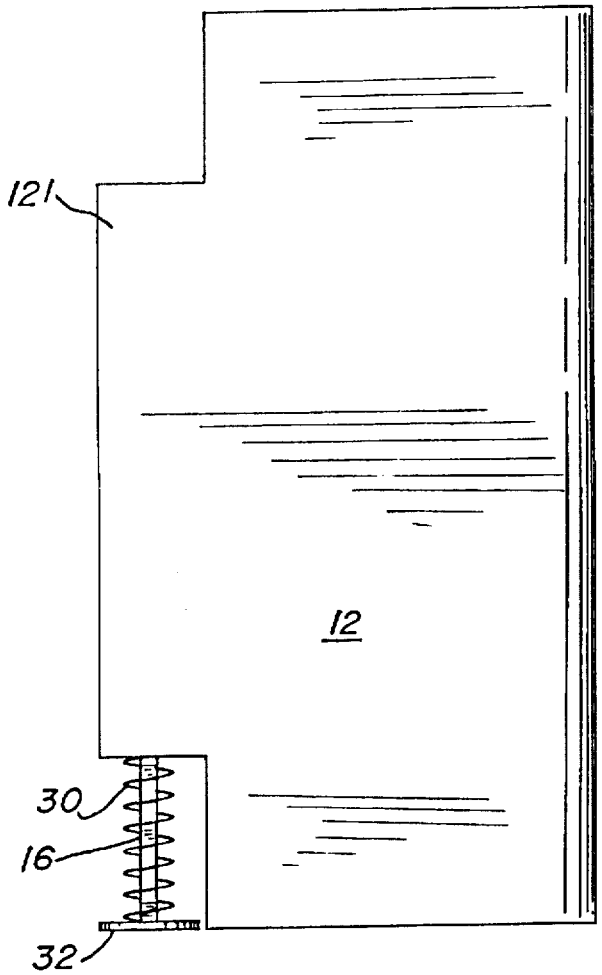
FIG. 3 is a side-elevational view thereof.
Figure 4:
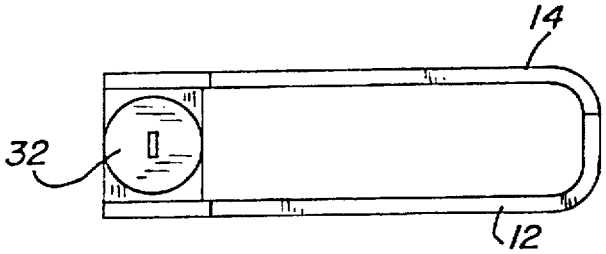
FIG. 4 is an end view thereof.
Figure 5:
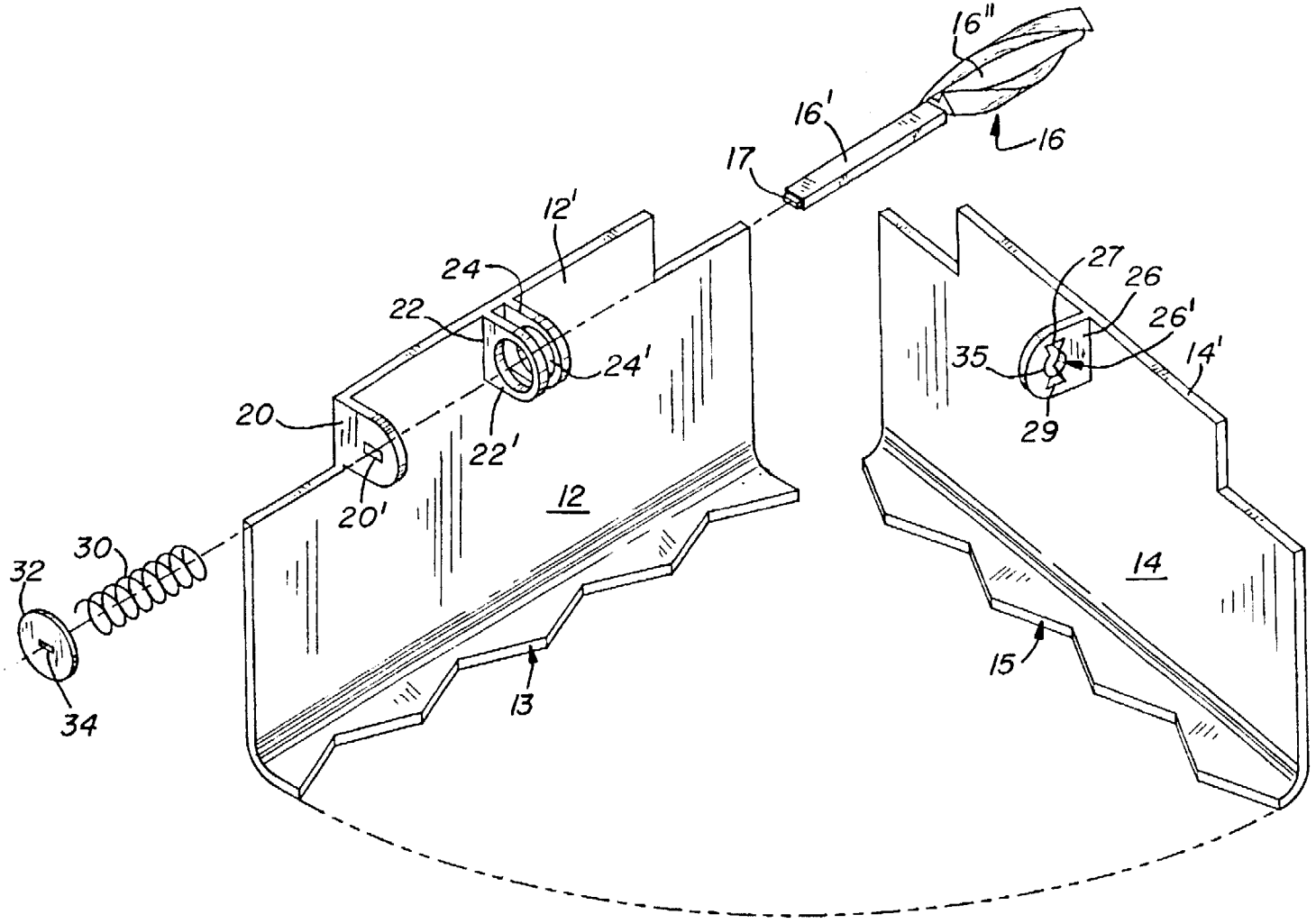
FIG. 5 is an assembly view, in perspective, of the clip of FIG. 1.
Figure 6:
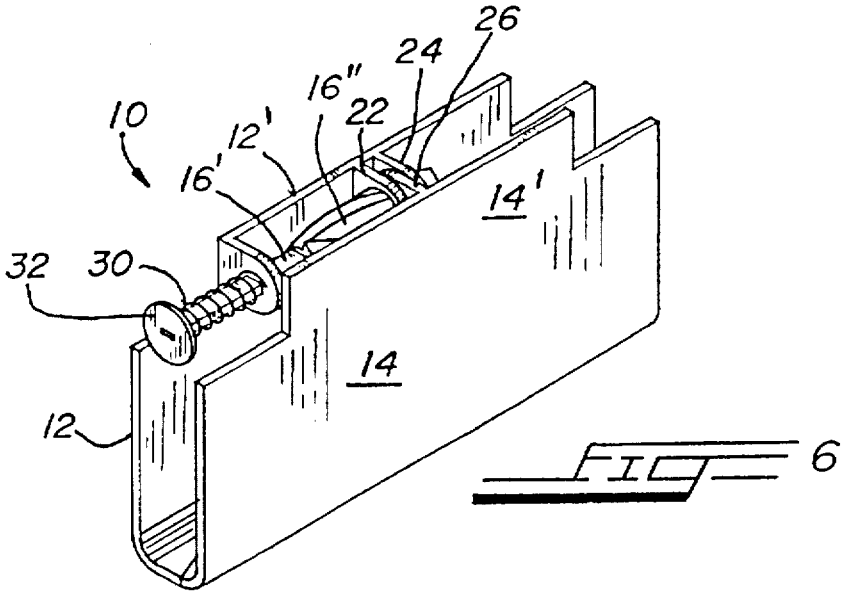
FIGS. 6–8 are isometric views of the clip of FIG. 1 showing the various stages of opening of the clip.

Referring now to the drawings in greater detail, the clip of the invention is indicated generally by reference numeral 10. The clip 10 has a pair of pivotally connected plate-halves 12, 14 which are spring-biased to their closed, contacting positions, as seen in FIGS. 4, and 6, with each plate-half having a lower clamping jaw 13, 15, respectively. The two plate-halves are pivotally, or rotatably, mounted to each other by means of a pivot pin, or shaft, 16. The first plate-half 12, for purposes of description, is considered the stationary plate-half, while the second plate-half 14 is the movable one. The first plate-half 12 is provided with a projecting, upper mounting section 12', to which corresponds a similar, projecting, upper mounting section 14' on the second plate-half 14. Protruding inwardly from the projecting, upper mounting section 12' are three bracket-mounts. A first bracket-mount 20 is located at the very edge of the projecting, upper mounting section 12', while the bracket-mounts 22, 24 are located approximately midway along the projecting, upper mounting section 12'. The two central bracket-mounts 22, 24 are spaced apart from each a distance that allows a fourth bracket-mount 26, protruding centrally and inwardly from the projecting, upper mounting section 14, to be received therebetween in a snug fashion. Each of the bracket-mounts 20–26 has a central hole, or cut-out, through which passes pivot shaft 16. The bracket-mount 20 has a rectangularly-shaped, interior opening 20', which matches the cross-sectional shape of the first end-section 16' of the pivot shaft, as seen in FIG. 1. Each of the two central bracket-mounts 22, 24 has a circular interior opening 22', 24', respectively, which are of large enough diameter so as to pass the helically-shaped, or screw-shaped, cross section of the second end-section 16" of the pivot shaft 16, as seen in FIG. 1. The fourth bracket-mount 26 has an interior opening 26' having the same general shape as the planar cross section of the helically-shaped portion of the second end-section 16", so that a portion of the helically-shaped cross section of the second end-section 16" may be received snugly therein; that is, the interior opening 26' of the bracket-mount 26 has an upper, triangularly-shaped section 27, and a lower triangularly-shaped section 29, with a central, circular section 35.

The first end-section 16' of the pivot shaft 16 projects partially, laterally outwardly beyond the first bracket-mount 20. This partially-projecting portion of the end-section 16' is telescopingly received in a linear spring 30. The distal end 17 of the end-section 16' protrudes beyond the end of the spring 30, and is closed off by a cap 32 having a rectangularly-shaped interior opening, or cutout 34, as that of the bracket mount 20. The two ends of the spring are sandwiched between the cap 32 and the bracket-mount 20, whereby the spring 30 is placed in compression.

Figure 7:
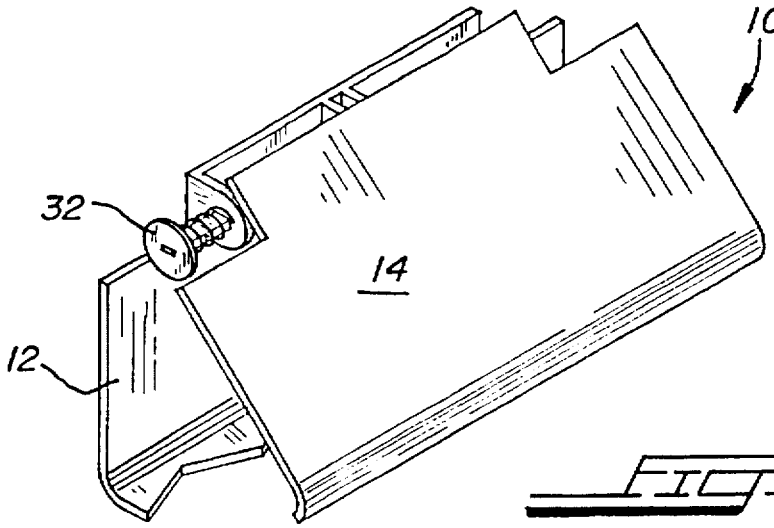
Figure 8:
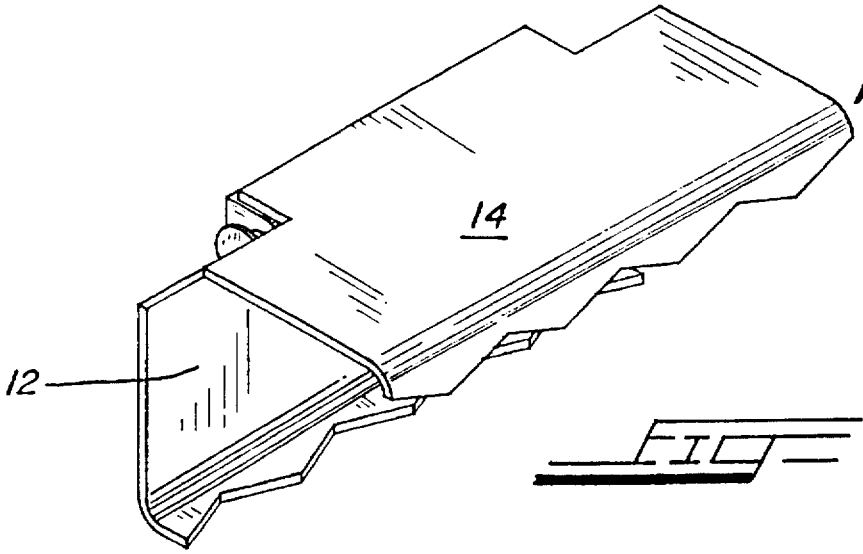
Figure 9:
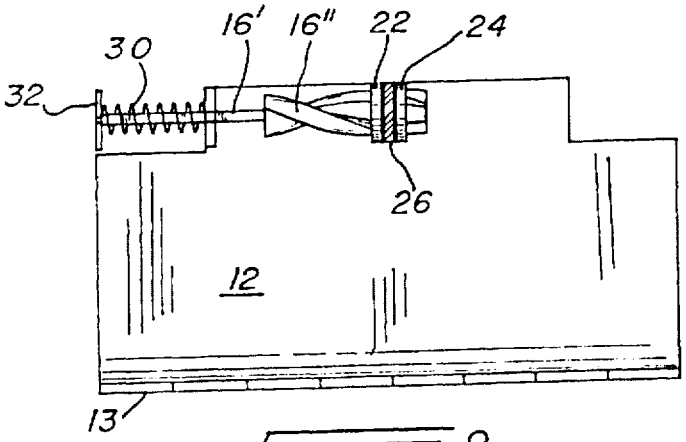
FIGS. 9–11 are partially-broken away front views showing the positioning of the linearly translating pivot rod, corresponding to the positions of FIGS. 6–8.
Figure 12:
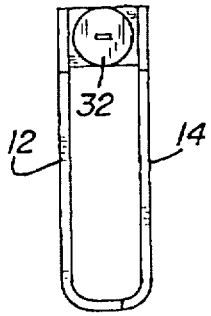
FIGS. 12–14 are end views thereof.
Figure 10:
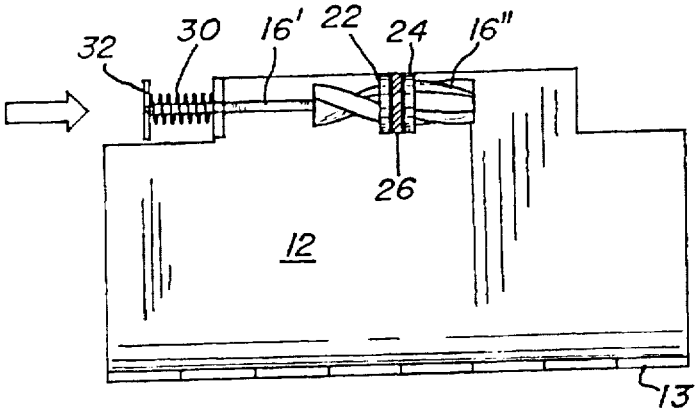
Figure 13:
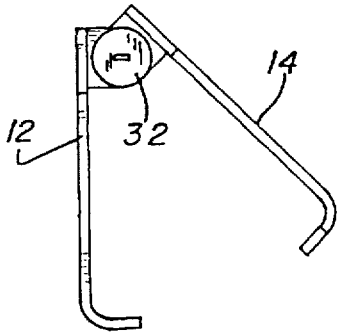
Figure 11:
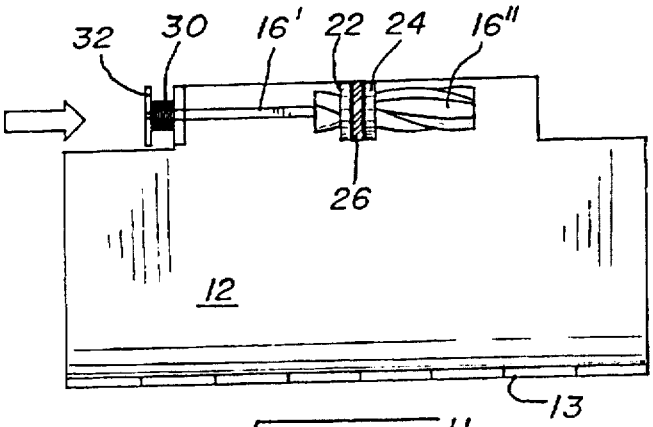
Figure 14:
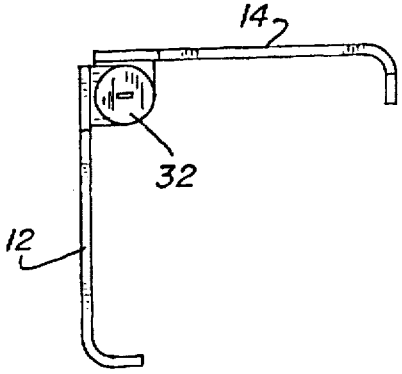

As may be seen when viewing FIGS. 9 and 12, in the static state of the clip 10, where no outside forces are applied, the linear spring 30 urges the cap 32 away from the bracket-mount 20, whereby the two plate-halves 12, 14 of the clip are forced into their closed, clamping position, where the clamping jaws 13, 15 thereof are in contact with each other to clamp an article therebetween. In order-to open these jaws, and to pivot open the two plate-halves, one grips the clip 10 with just one hand, as seen in FIG. 1, with the thumb contacting the end-face of the clip opposite to that where the spring is located, and with the the forefinger contacting the cap 32. The person then squeezes the clip with his hand, forcing the cap 32 to move toward the bracket-mount 20, which forces the pivot shaft to translate linearly through the bracket-mounts 20–26. The pivot shaft then passes through the interior openings of these bracket-mounts. However, since the interior of the bracket-mount 26 is of an approximate planar, helical, cross-sectional shape, as the pivot shaft translates through the opening 26', it forces the second plate-half 14 to pivot about the pivot shaft 16, in order for the planar, helical, cross-sectional shape of the opening 26' to match the helical, cross sectional shape of the end-portion 16". To partially pivot open the second plate-half 14 by 45 degrees, as seen in FIGS. 7, 10 and 13, one moves the cap 32 approximately half the distance to the bracket-mount 20; to pivot open the second plate-half 14 a full 90 degrees, as seen in FIGS. 8, 11 and 14, one moves the cap 32 all the way against the bracket-mount 20. As soon as one releases the cap 32, the spring 31 automatically causes the second plate-half 14 to rotate back to its closing position.

While a specific embodiment of the invention have been shown and described, it is to be understood that numerous changes and modifications may be made therein without departing from the scope, spirit and intent of the invention as set forth in the appended claims. The above-described invention can also apply to any use of two pivotally-mounted plates, where one state thereof is preferred, and has use outside the clip or clamping arts. For example, the two plate-halves 12, 14 may constitute a switch where the jaws 13, 15 are electrically conductive and close a circuit in their closed state, and open a circuit in their open state. Other uses are also envisioned.

What I claim is:

1. A method of using a clip, which clip comprises:

pivotally-mounted first and second clip-halves, each having a contacting surface for abutting engagement against another contacting surface, a pivot shaft having g longitudinal axis for mounting said first and second clip-halves together, said pivot shaft having at least one part thereof defining a screw-like cross section, biasing means for urging said pivot shaft in a first direction along said longitudinal axis and pivot-shaft mounting means mounted by said first and second clip-halves for mounting said pivot shaft for sliding movement therein, said pivot-shaft mounting means having a part thereof having an appropriately-shaped, interior opening for receiving therethrough said at least one part defining a screw-like cross section, said method comprising:

(a) holding the clip between the thumb and a finger of one hand;

(b) said step (a) comprising applying pressure by means of one of the finger and thumb against one end of said pivot shaft, and applying pressure by means of the other of finger and thumb against another part of the clip;

(c) squeezing the finger and thumb together to move said at least one part defining a screw-like cross section of said pivot shaft in a second direction along said longitudinal axis and against the biasing force of said spring, and through said appropriately-shaped interior opening; and (d) said step (c) causing said pivotally-mounted first and second clip-halves to separate from each other.

2. The method of using a clip according to claim 1, further comprising:

(e) releasing said pivot shaft from the squeezing force of said step (c), whereby said spring is allowed to return the clip-halves to their closed state, where the contacting surfaces of said clip-halves are in at least close proximity to each other.

3. A method of using a clip having a pair of pivotally mounted jaw elements for holding an item therebetween, a Divot shaft for pivotally mounting the law elements and biasing means for providing a biasing force, comprising:

(a) holding the clip between the thumb and a finger;

(b) said step (a) comprising applying pressure by means of one of the finger and thumb against one end of the pivot shaft, and applying pressure by means of the other of the finger and thumb against another part of the clip;

(c) squeezing the finger and thumb together to move the pivot shaft in a first longitudinally axial direction of the pivot shaft against the biasing force of the spring; and (d) said step (c) causing the pivotally-mounted pair of jaw element to separate from each other; and (e) releasing the pivot shaft from the squeezing force of said step (c); whereby the biasing force of the spring automatically slides the pivot shaft in a second opposite longitudinally axial direction of the pivot shaft, whereby the jaw elements are returned to their initial closed state.

* * * * *